US009399839B2

(12) United States Patent
Moss et al.

(10) Patent No.: US 9,399,839 B2
(45) Date of Patent: Jul. 26, 2016

(54) FRUIT FIBER PROCESSING SYSTEM AND METHOD

(71) Applicants: Peter R. Moss, Richmond, TX (US); Doug A. Bippert, Marietta, GA (US); Rajesh Kumar Garg, Atlanta, GA (US); Kim W. Robinson, Powder Springs, GA (US); Simon Gainey, Media, PA (US); Philip G. Crandall, Fayetteville, AR (US)

(72) Inventors: Peter R. Moss, Richmond, TX (US); Doug A. Bippert, Marietta, GA (US); Rajesh Kumar Garg, Atlanta, GA (US); Kim W. Robinson, Powder Springs, GA (US); Simon Gainey, Media, PA (US); Philip G. Crandall, Fayetteville, AR (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 13/865,933

(22) Filed: Apr. 18, 2013

(65) Prior Publication Data

US 2013/0276999 A1 Oct. 24, 2013

Related U.S. Application Data

(60) Provisional application No. 61/635,073, filed on Apr. 18, 2012.

(51) Int. Cl.

| | |
|---|---|
| ***D21C 3/00*** | (2006.01) |
| ***D21H 21/32*** | (2006.01) |
| ***D21H 11/12*** | (2006.01) |
| ***D21C 5/00*** | (2006.01) |
| ***D21H 17/64*** | (2006.01) |
| *D21H 27/10* | (2006.01) |
| *D21C 9/10* | (2006.01) |

(52) U.S. Cl.

CPC ..... *D21H 21/32* (2013.01); *D21C 3/00* (2013.01); *D21C 5/00* (2013.01); *D21H 11/12* (2013.01); *D21H 17/64* (2013.01); *D21C 9/10* (2013.01); *D21H 27/10* (2013.01)

(58) Field of Classification Search

CPC ..... D21C 5/00; D21H 11/12; D21H 11/10; A21D 2/188

USPC ..... 162/91, 99

See application file for complete search history.

(56) References Cited

U.S. PATENT DOCUMENTS

| | | | | |
|---|---|---|---|---|
| 4,831,127 | A | 5/1989 | Weibel | |
| 4,923,981 | A | 5/1990 | Weibel et al. | |
| 5,705,216 | A | 1/1998 | Tyson | |
| 5,759,704 | A | 6/1998 | Horiuchi et al. | |
| 5,964,983 | A * | 10/1999 | Dinand et al. | 162/27 |

(Continued)

FOREIGN PATENT DOCUMENTS

| | | | |
|---|---|---|---|
| WO | 92/08842 | A2 | 5/1992 |
| WO | 03/000983 | A1 | 1/2003 |

(Continued)

OTHER PUBLICATIONS

International Search Report and Written Opinion for corresponding PCT/US2013/037242 mailed Oct. 1, 2013.

*Primary Examiner* — Jacob Thomas Minskey

(74) *Attorney, Agent, or Firm* — Dentons US LLP

(57) ABSTRACT

A system and method of manufacturing a fiber for use in manufacturing products including providing a feedstock including fiber derived from edible fruit of a plant. An agent that degrades pectin may be applied to the feedstock to form a feedstock mixture. The feedstock mixture may be agitated, and solution including the fiber from the feedstock mixture may be removed. The fiber may be isolated from the solution.

21 Claims, 9 Drawing Sheets

(56) References Cited

U.S. PATENT DOCUMENTS

| | | | | |
|---|---|---|---|---|
| 6,187,580 | B1 | 2/2001 | Andersen et al. | |
| 2008/0146701 | A1* | 6/2008 | Sain et al. | 524/9 |
| 2010/0287826 | A1* | 11/2010 | Hoffman et al. | 44/605 |

FOREIGN PATENT DOCUMENTS

| | | | |
|---|---|---|---|
| WO | 2004/081185 | A2 | 9/2004 |
| WO | 2012/000887 | A1 | 1/2012 |

* cited by examiner

WATER TO PELLETS (OD) SOLIDS AT ROOM TEMPERATURE OVER STEEPING TIME

FREE WATER AFTER DRAINING
LIQUID TO SOLIDS RATIO
7.0
6.0
5.0
4.0
3.0
2.0
1.0
0.0
0
5
10
15
20
25
30
35
40
45

SW:HW AND CITRUS PULP BLENDS PHYSICAL PROPERTIES

10%
20%
30%
35.0
30.0
25.0
20.0
15.0
10.0
5.0
0.0
BREAKING LENGTH
km
TEAR INDEX
mN*m^2/g
RESISTANCE TO BENDING
mN

FIG. 10B

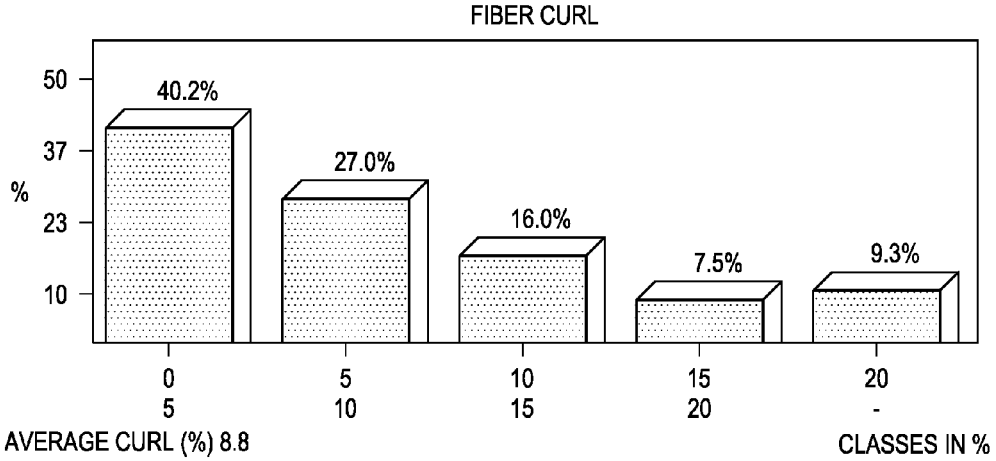

| AVERAGE CHARACTERISTICS | | NUMBER OBJECTS |
|---|---|---|
| FIBERS (MILLION/g) | 4.529 | TOTAL = 759164 |
| LENGTH: ARITHMETIC AND WEIGHTED IN LENGTH | 0.311 0.358 | 5007 |
| WIDTH (μm) | 27.7 | |
| COARSENESS (mg/m) | 0.5636 | |
| KINK ANGLE (°) | 124 | |
| KINKED FIBERS (%) | 14.8 | |
| CURL (%) | 8.8 | |
| RATE IN LENGTH OF MACROFIBRILLS (%) | 2.221 | |
| BROKEN ENDS (%) | 45.98 | |
| FINE ELEMENTS (% IN LENGTH) | 94.5 | 754157 |
| PERCENTAGE OF FINE ELTS (% IN AREA) | 67.80 | |

LENGTH (mm) FIBER DISTRIBUTION IN PERCENTAGE (NOT WEIGHTED)

| | | | | | | |
|---|---|---|---|---|---|---|
| 10.00- | 0 | 0 | 0 | 0 | 0 | 0 |
| 5.72-10.00 | 0 | 0 | 0 | 0 | 0 | 0 |
| 3.27-5.72 | 0 | 0 | 0 | 0 | 0 | 0 |
| 1.87-3.27 | 0 | 0 | 0 | 0 | 0 | 0 |
| 1.07-1.87 | 0 | 0 | 0 | 0 | 0 | 0 |
| 0.61-1.07 | 0 | 0 | 0 | 0 | 0 | 2 |
| 0.35-0.61 | 1 | 2 | 2 | 1 | 1 | 11 |
| 0.20-0.35 | 7 | 9 | 7 | 7 | 6 | 43 |
| | 5 8 | 8 11 | 11 14 | 14 17 | 17 20 | 20 - |

LEVEL

NUMBER OF FIBERS ANALYZED (TOTAL): 5007

WIDTH (μm)

FIG. 11B

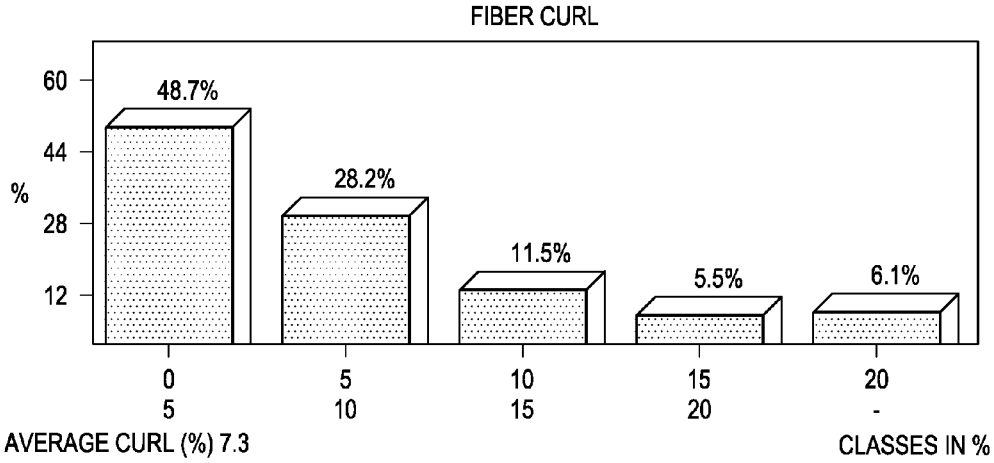

| AVERAGE CHARACTERISTICS | | NUMBER OBJECTS |
|---|---|---|
| FIBERS (MILLION/g) | 28.941 | TOTAL = 30115 |
| LENGTH: ARITHMETIC AND WEIGHTED IN LENGTH | 0.578 0.697 | 5010 |
| WIDTH (μm) | 17.0 | |
| COARSENESS (mg/m) | 0.0567 | |
| KINK ANGLE (°) | 132 | |
| KINKED FIBERS (%) | 35.1 | |
| CURL (%) | 7.3 | |
| RATE IN LENGTH OF MACROFIBRILLS (%) | 0.551 | |
| BROKEN ENDS (%) | 19.04 | |
| FINE ELEMENTS (% IN LENGTH) | 32.1 | 25105 |
| PERCENTAGE OF FINE ELTS (% IN AREA) | 9.36 | |

LENGTH (mm) FIBER DISTRIBUTION IN PERCENTAGE (NOT WEIGHTED)

| | | | | | | |
|---|---|---|---|---|---|---|
| 10.00- | 0 | 0 | 0 | 0 | 0 | 0 |
| 5.72-10.00 | 0 | 0 | 0 | 0 | 0 | 0 |
| 3.27-5.72 | 0 | 0 | 0 | 0 | 0 | 0 |
| 1.87-3.27 | 0 | 0 | 0 | 0 | 0 | 0 |
| 1.07-1.87 | 0 | 0 | 1 | 1 | 1 | 2 |
| 0.61-1.07 | 3 | 5 | 6 | 6 | 4 | 8 |
| 0.35-0.61 | 5 | 7 | 7 | 8 | 6 | 11 |
| 0.20-0.35 | 2 | 2 | 3 | 3 | 2 | 7 |
| | 5 8 | 8 11 | 11 14 | 14 17 | 17 20 | 20 - |

LEVEL

NUMBER OF FIBERS ANALYZED (TOTAL): 5010

WIDTH (μm)

FRUIT FIBER PROCESSING SYSTEM AND METHOD

RELATED APPLICATIONS

This application claims priority to U.S. Provisional Patent Application 61/635,073 filed Apr. 18, 2012, the contents of which are hereby incorporated by reference in their entirety.

FIELD OF THE INVENTION

The principles of the present invention are directed to a method for processing an edible fruit by-product ("fruit by-product") to produce fruit fiber ("fruit fiber"), and more specifically, to a method for processing a fruit by-product, such as citrus by-product, to provide fruit fiber useful in the manufacture of paper, including packaging, writing, and other papers. The principles of the present invention also relate to articles, such as paper and packaging, containing fruit fiber as a partial replacement for wood fiber.

BACKGROUND OF THE INVENTION

Wood fiber has been used in the manufacture of paper and packaging since the mid 1800's. Although wood fiber continues to offer valued performance characteristics, its poor environmental profile had led to the search for alternative fibers to at least partially replace the wood fiber. Various non-wood fibers have been suggested, including sugar cane, bagasse, wheat and rice straws, bamboo, cotton stalks, banana leaves, fig leaves, reed, amur grass, and kenaf.

The citrus family is a large and diverse family of flowering plants. Common varieties of citrus fruit include oranges, grapefruits, lemons, and limes. The fruit is considered to be a specialized type of berry, characterized by a leathery peel and a fleshy interior containing multiple sections filled with fluid-filled sacs. Citrus fruits contain pectin, a gel-forming polysaccharide common in fruits, but found in particularly high concentration in citrus fruit.

Selected varieties of citrus fruit, including the sweet orange and the grapefruit, are processed commercially to provide juice and sections. About 45 to 60 percent of their weight remains post-processing, in the form of peel, rag and seeds. The by-product volume is significant; Florida's citrus processing plants alone produce 5 million tons of wet citrus by-product annually. The high water content and perishable nature of wet citrus by-product typically limits its potential usefulness to applications in close physical proximity to the processing plant. The most common commercial use of fruit by-product is dried citrus pellets, which is commonly used as animal feed.

SUMMARY

The principles of the present invention provide for systems and methods that may be used as a partial replacement to wood pulp or wood pulp fiber in manufacturing articles, such as paper and packaging. One system and method may include pre-processing fruit by-product to create brighter fruit by-product and fiber than is currently available as a starting point for processing the fruit fiber for use in manufacturing paper and packaging. Another system and method may include processing the fruit fiber derived from the fruit by-product to create brighter fiber than is currently possible for use in a variety of paper products. An article may be produced inclusive of two naturally produced fibers, where one of the fibers, such as fruit fiber, may include filaments extending therefrom.

In an embodiment, the principles of the present invention provide a method of manufacturing a feedstock for producing paper fiber from fruit of a plant. The method may include providing a by-product source inclusive of fiber from the edible fruit after a process for removing a majority of the edible fruit is used to produce a food. One or more treatment processes to brighten the fruit by-product may be performed. The feedstock may be produced from the brightened fruit by-product.

In an embodiment, the principles of the present invention provide a method of manufacturing a fiber for use in manufacturing products. The method may include providing a feedstock including fiber derived from edible fruit of a plant, applying an agent that degrades pectin to the feedstock to form a feedstock mixture, agitating the feedstock mixture, removing solution including the fiber from the feedstock mixture, and isolating the fiber from the solution.

In an embodiment, the principles of the present invention provide a system for manufacturing a fiber for use in manufacturing products. The system may include an input structure configured to receive a feedstock including fiber derived from edible fruit of a plant. A reactor tank may be in fluid communication with the input structure. An input conduit may be in fluid communication with the reactor tank, and be configured to flow an agent that causes pectin in the feedstock to degrade. The reactor tank may be configured to receive the feedstock from the input structure and to receive the agent from the input conduit so as to mix the agent with the feedstock to form a feedstock mixture inclusive of agent and feedstock. The reactor tank may further be configured to agitate the feedstock mixture. An output conduit may be in fluid communication with the reactor tank, and be configured to remove solution inclusive of agent and fiber from the feedstock mixture. Means for isolating the fiber from the solution may be in fluid communication with the output conduit.

In an embodiment the principles of the present invention may provide an article including a first fiber derived from a first natural source and a second fiber derived from a fruit.

In an embodiment, the principles of the present invention provides a method of manufacturing an article may include combining a first and second fiber to form a fiber mixture, where the first and second fibers are obtained from discrete materials, and where at least one of the fibers is derived from an edible fruit of a plant. The article may be formed from the fiber mixture.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION

Figure 1:
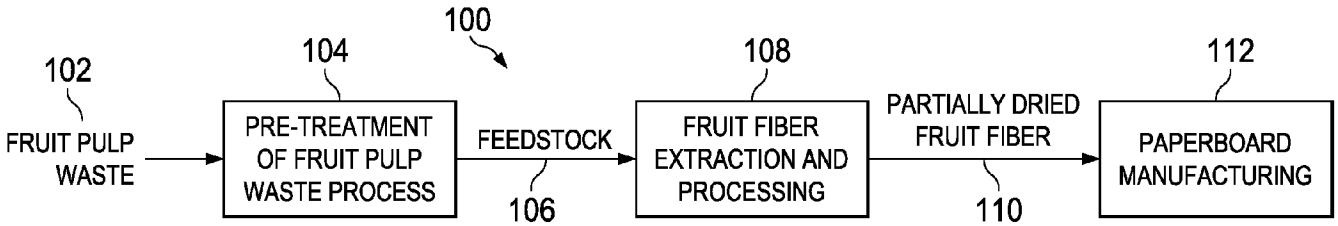
FIG. 1 is a flow diagram of an illustrative process for pre-treating wet fruit pulp by-product and treating fruit fiber for use in paperboard manufacturing.

The principles of the present invention are directed to a method for processing fruit by-product to produce fiber obtained from the fruit by-product. The method may include digesting the fiber by-product to release or extract the fibrous material from pectin and/or the ultrastructure of the fruit by-product. The fruit fiber is useful as a substitute for wood fiber in articles such as paper materials, including as packaging paper, where replacement in various amounts nevertheless preserves the desired performance characteristics.

The principles of the present invention are also directed to articles, such as paper, including packaging paper containing fruit fiber extracted from fruit by-product, i.e., wood fiber-reduced paper or packaging paper, and methods for making the same.

In certain embodiments, the principles of the present invention are directed to a method for processing citrus or non-citrus fruit by-product to provide fiber obtained from citrus or non-citrus fruit by-product including for use in manufacturing paper and packaging paper, as well as papers and packing papers containing citrus or non-citrus fruit fiber as a substitute for wood fiber.

In certain embodiments the principles of the present invention are directed to a purified fruit fiber that includes filaments extending axially therefrom.

I. Method of Processing Fruit by-Product

The principles of the present invention provide for a method for processing fruit by-product to produce fruit fiber. The process may include pre-processing the fruit by-product by (i) providing a fruit by-product, (ii) treating the fruit by-product to produce a refined fruit by-product, and (iii) optionally neutralizing charge of the refined fruit by-product to produce neutralized fruit by-product. In one embodiment, a brightening agent, such as bleach, may be applied to the fruit by-product to produce a brightened fruit by-product and, consequently, brightened fruit fiber, thereby being more readily usable to be included in a wider variety of paper and packaging.

The refined and/or neutralized fruit by-product can be treated further (e.g., dried, brightened, further refined, filtered, and screened) to provide a fruit fiber that can be used for different papers and/or packaging processing. Fruit by-product may be any components of an edible fruit of a plant that remains after processing the edible fruit to produce food for human or animal consumption. For instance, fruit by-product includes but is not limited to internal membranous tissue within the fruit. This tissue includes, but is not limited to albedo, endocarp, segment membranes and the like, of citrus, as is known in the art. Fruit "by-product" includes pulp and other subfractions, such as peel (exocarp), seeds and the like. As used herein, "pulp" includes sub-fractions of citrus, such as albedo (mesocarp), segment (endocarp), and segment membranes. Generally, the term "fiber" is used to refer to extracted fibrous material from fruit by-product, as opposed to "by-product" or "pulp," which refers to the fiber and other structural and chemical compositions (e.g., pectin) in edible fruit.

With regard to FIG. 1, a flow diagram of an illustrative process 100 for pre-treating fruit by-product and treating fruit fiber for use in paperboard manufacturing is shown. The process 100 may start by providing fruit by-product 102, such as wet fruit by-product, into a pre-treatment of fruit by-product process 104. The process 104 may be used to prepare a feedstock 106 by washing, removing molasses, and removing non-fibrous matter (e.g., leaves, seeds, solids with sugars, and other components and plant parts, such as wood, stalks, and leaves), and/or applying a brightening agent to the fruit by-product 102. By pre-treating the fruit pulp by-product 102 to be cleaner, and hence brighter, the fruit by-product may be a better feedstock than currently available, which is generally cattle feed pellets with molasses. In accordance with the principles of the present invention, the feedstock may be provided from the process 104 in a variety of forms, including a slurry, pellets without binding material, cellulose feedstock with about 1% to about 10% fiber, or in some embodiments about 2% to about 5% fiber, or otherwise.

The feedstock 106 may be provided to a fruit fiber extraction and processing process 108. The process 108 may extract or otherwise isolate fruit fiber from the fruit pulp. The process 108, in addition to extracting fruit fiber from the fruit pulp, may also brighten the fruit fiber, as further described herein with regard to FIG. 3, so as to be brighter and more usable for different types of paper, such as product packaging and writing paper. Output from the process 108 may be partially dried fruit fiber 110. In one embodiment, the partially dried fruit fiber 110 may be in the form of wet lap. In drying the fruit fiber 110, any system and process for partially drying the fruit fiber may be utilized, including but not limited to using mechanical force (e.g., compressing the fruit fiber), air drying, fluidized bed drying, P-ring drying, freeze drying, and the like, or combination thereof.

Figure 2:
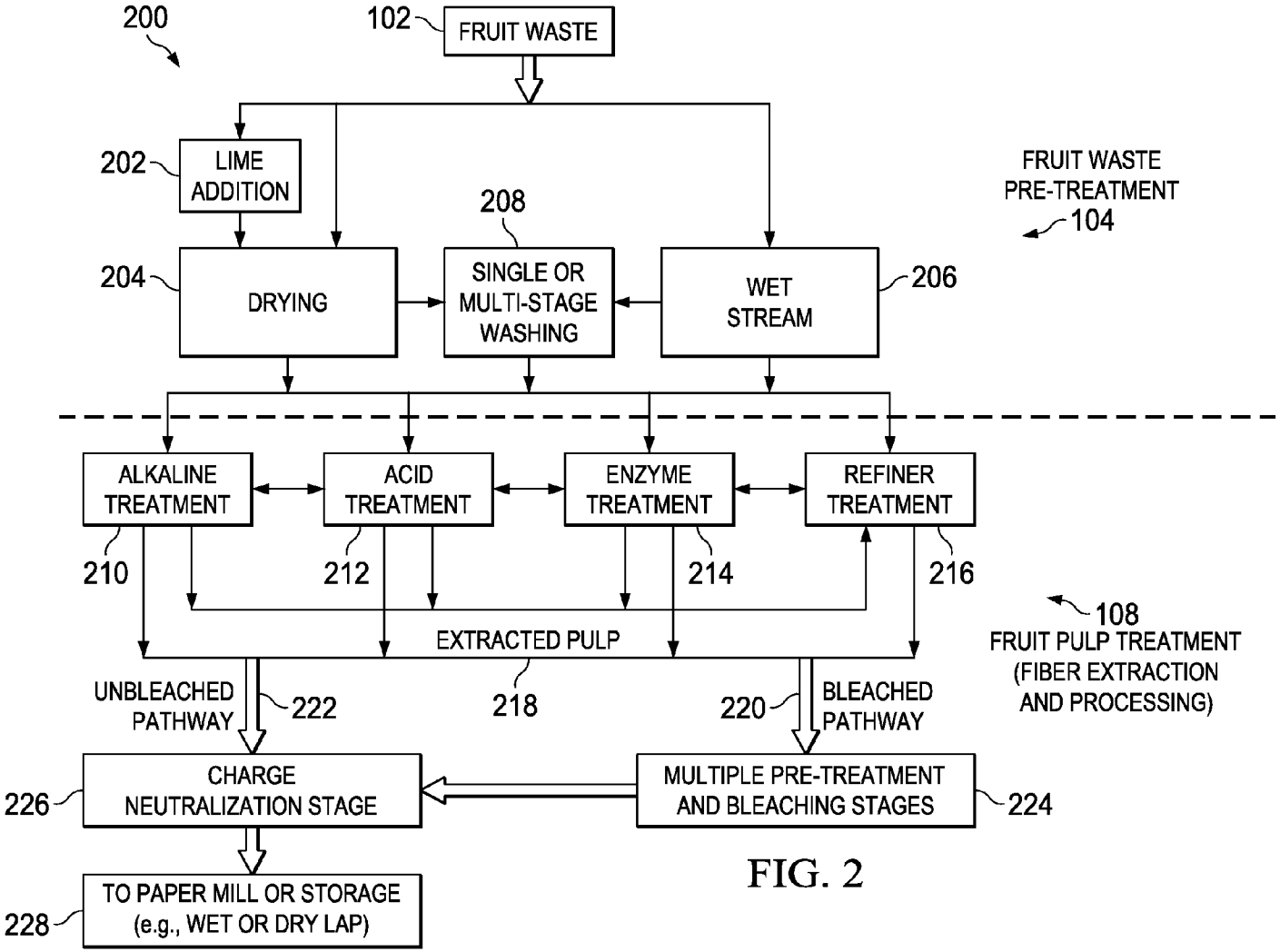
FIG. 2 is a flow diagram of a more detailed illustrative process for pre-treating wet fruit pulp by-product and treating fruit fiber for use in paperboard manufacturing.

With regard to FIG. 2, a more detailed illustrative process 200 for the fruit by-product pre-treatment process 104 and the fruit fiber treatment process 108 to extract and process fruit fiber for use in paperboard manufacturing is shown.

A. Fruit by-Product

The fruit by-product 102 provided to the pre-treatment process 104 may vary amongst different fruits, but contain an adequate amount of pulp and fiber for use as a wood fiber replacement. The fruit by-product may be wet by-product, never dried by-product or pulp (fresh-never dried by-product or pulp), dry by-product or pulp, or pelleted by-product or pulp. The fruit by-product 102 may contain residual peel, rags/sacks, and seeds, as described further herein. In one embodiment, the fruit by-product is a citrus by-product and is in the form of citrus pellets, which, as understood in the art, is commonly used as animal feed.

Pelleted fruit by-product may be produced in varying ways using a variety of fruit source materials that may impact the content and characteristics of the pellet, as understood by one skilled in the art. For example, specific processing procedures vary from one production source to another and may vary with in the same source throughout the season. The basic procedure for producing fruit pellets generally includes grinding or chopping fruit and then dehydrating the fruit residue. The fruit residue is either dehydrated or pressed and molasses is produced from the press liquor. A portion of the molasses is sometimes added back to the fruit pulp during a drying process to bind the pulp by-product. The finer particles of the dried pulp are often removed and either sold as citrus meal or pelleted and added back to the pulp. These and other differences in processing, in source and variety of fruit, and in type of fruit food processing operation from which the fruit residue is obtained, may result in variations in the content of dried fruit pulp. However, by not including molasses, a brighter fruit by-product, in whatever form, may be provided to the fruit pulp treatment process 108.

Upon receipt, dry fruit pellets containing peel, rags and seeds may be tested for moisture content using a drying oven and scale. Moisture content may range, for example, between about 7% and about 18%. The fruit pellets used in subsequent treatments may be stored in tanks, bags, vats, and/or drums.

B. Fruit

Continuing with the fruit by-product 102, any edible fruit grown from a plant may be suitable for use with the principles of the present invention. The fruit by-product 102 may include by-product from a single fruit variety or multiple fruit varieties. For example, citrus fruit varieties suitable for use in producing fiber for use in producing paper may include, but are not limited to, any fruit from the Citrus genus, such as oranges, sweet oranges, clementines, kumquats, limes, leeche limes, satsumas, mandarins, tangerines, citrons, pummelos, lemons, rough lemons, grapefruits, tangerines and tangelos, or hybrids thereof. The citrus fruit may be early season, mid-season, or late-season citrus fruit. The pectin content of fruit may vary based on season, where ripe fruit may contain less pectin than unripe fruit. It should be understood that non-citrus fruits (e.g., apples) may alternatively or additionally be utilized. Thus, in one embodiment, the principles of the present invention provide for a method for isolating and processing non-citrus fruit by-product to obtain non-citrus fruit pulp or fiber. These materials are also useful in the production of paper and packaging papers, where they may also serve as a substitute for wood fiber. These non-citrus fruits include, for example, apple, mango and papaya. The fiber and pectin content of these non-citrus fruits would be understood by one of skill in the art to vary.

In one embodiment, the fruit by-product may include citrus by-product from oranges. In one embodiment, mid-season fruits (e.g. Pineapple and Sunstar varieties) and late-season fruits (e.g. Valencia) may be used to provide adequate cellular fibrous material.

The fruit by-product may include all fruit by-product or a specific fraction of the fruit by-product, where fractions may include, but are not limited to, peels, rags, sacs, and seeds. In one embodiment, peels and rags/sacks are used as a fruit fiber source. In one embodiment, albedo, endocarp or segment membranes and/or vesicle membranes are used as fiber sources individually or in combination.

The solid fruit concentration of the fruit by-product may vary. In one embodiment, the fruit by-product is a wet fruit by-product having a solid fruit concentration of from about 4% to about 30%. In another embodiment, the solid fruit concentration of the wet fruit by-product is about 8% to about 20%. In another embodiment, the fruit by-product is a dry fruit by-product having a solid fruit concentration of from about 80% to about 95%. In a specific embodiment, the dry fruit by-product has a solid fruit concentration in a range from about 84% to about 95%.

The fruit by-product may vary based on type of fruit, density of fruit by-product, concentration of fruit by-product, wetness of fruit by-product, and so on.

C. Pre-Treatment Process

With further regard to FIG. 2, the fruit by-product may optionally be pre-treated prior to digestion in order to prepare the material for subsequent treatment steps. The pre-treatment process 104 may involve a single step or multiple steps, where multiple steps may be the same or different. The pre-treatment process 104 may include adding lime to the fruit by-product to dewater the fruit by-product 102 at step 202. At step 204, the fruit by-product 102, which may or may not have had lime added thereto, may be dried. The drying process may include partially or fully drying the fruit by-product 102, with or without lime. In an alternative embodiment, the fruit by-product 102 may be processed as a wet stream at step 206. In one embodiment, single or multi-stage washing processes may be performed at step 208. The washing processes may cause the fruit pulp that is part of the fruit by-product to be cleaned and brightened. Baths, high-pressure spray, gentle shower, and any temperature water may be used. Other steps for pre-treating the fruit by-product may be performed, including performing a dewatering step (not shown) that may be part of the drying process at step 204 or post the washing process at step 208.

More specifically, washing processes 208 may vary, for example, in temperature or number of washes. The water may be cold, ambient (23-27° C.) or hot (50-60° C.). Hot water has been shown to remove more soluble components on a relative basis than an equivalent amount of ambient water (e.g., 1% to 5% more). Fresh water washing or a multistage, countercurrent scheme may be employed. Multistage washing has been shown to remove more soluble materials than a single washing (e.g., 1%-4% more). In a particular embodiment, the number of washing steps may range from two to five or more. The washing step(s) may occur at a fruit juicing plant or at an offsite-processing location. Washing may occur with or without stirring/agitation (i.e., in a quiescent environment). In one embodiment, the washing process at step 208 may remove from about 1%, about 2%, about 3%, about 4%, about 5%, about 6%, about 7%, about 8%, about 9%, about 10%, about 11%, about 12%, about 13%, about 14%, about 15%, about 20%, about 25%, about 30%, about 35%, about 40% or about 50% of the soluble materials.

In a particular embodiment, untreated pellets are transferred to a suitable vessel and washed with multiple (e.g., 9) times its weight (10% solids) in ambient (23-27° C.) water to both swell the pellets and remove water soluble materials for a minimum of about 10 minutes to about 15 minutes. pH may be monitored during the multistage pH neutral water washing of the pulp to determine when the pulp has been sufficiently rinsed.

To further improve brightness of the fruit pulp, a bleaching step (not shown) may be included. The bleaching step may use bleach or any other chemical or non-chemical process, as understood in the art. In a particular embodiment, the bleaching pre-treatment is a peroxide, alkaline peroxide, or oxygen-alkali treatment. In another embodiment, the bleaching pre-treatment step is involves treatment with hydrogen peroxide. For example, there are two, three, four or pre-treatment bleaching steps. By brightening the fruit pulp, fewer processes, which may be more time consuming and costly, may be performed in the fruit pulp treatment process 108. In addition, an attrition step or any other step useful or necessary to prepare the material for subsequent digestion or brightening may be performed in the pre-treatment processes 104.

In one embodiment, the pre-treatment step may reduce a water retention value (WRV) of the fruit by-product. WRV can be measured, for example, by centrifugally separating water retained in pulp from free water in and between fruit fibers.

In another embodiment, the pre-treatment process 104 may decrease the chemical load (i.e., the presence of soluble materials, such as sugars or acids) of the material prior to digestion. The chemical load may vary depending upon the type of fruit by-product and/or the processing conditions used to generate the fruit by-product. Pretreatment to remove soluble materials may be particularly useful where molasses has been added to a fruit pellet during processing. Pellets to which molasses has been added may have far greater levels of soluble material (e.g., 40%-50% or so of the total weight of the dry pellet).

Figure 6:
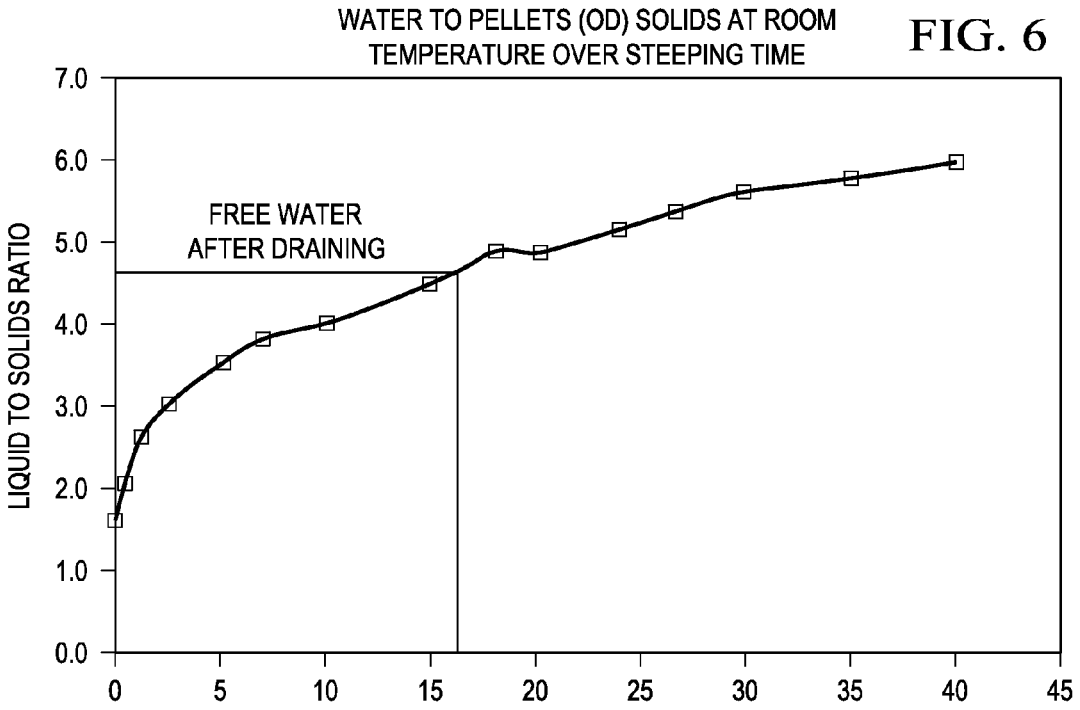
FIG. 6 is a graph of illustrative data showing an uptake of water by citrus pellets at room temperature over time, expressed as the ratio of liquid to solid.

With regard to FIG. 6, a graph of illustrative data establishing citrus pellet uptake of water over time is shown. Generally, dried pellets expand in volume upon wetting with excess water and have a several fold water holding capacity over the dry weight of the by-product. About 5 times of the weight of the dry by-product may be taken up by the by-product upon standing. This uptake is rapid and reaches near-steady state equilibrium after about 40 minutes at room temperature.

The pre-treatment process 104 (FIGS. 1 and 2) may involve one or more dewatering steps. For example, the by-product may be subject to washing and then dewatered by any suitable technology, such as pressing swollen pellets through a screw press or over a vacuum-assisted drainage device, by centrifugal force, or by mechanical and/or fabric pressing. Solids and yield of the washed pellet by-product may then be determined by drying a sample. In a particular embodiment, the cake solids levels range may range from about 7% to about 33%.

In yet another embodiment, the pre-treatment process 104 may include an attrition treatment (not shown). Attrition may, for example, permit bleaching chemicals used in another step additional or improved access to the material, i.e., so that diffusion is not limiting. A mechanical means may be used to continuously reduce the size of citrus by-product prior to any bleaching step in order to provide thorough diffusion access of the bleaching chemical to all parts of the by-product. In one embodiment, moderate shear devices (e.g., produced by British Disintegrator) may be used or a continuous and conventional pulp refiner (e.g., double disk refiner) with plate clearances between 0.125" and 0.010" may be used. In a particular embodiment, process temperatures may range from about 25° C. to 95° C. As the by-product mass is relatively soft, there are likely many mechanical and frictional means to provide moderate shear to break down larger citrus by-product particles. Optionally, this step may be performed after bleaching unless the fibers and cells are of a sufficient size after bleaching is complete. In one embodiment, the citrus pulp may be screened to exclude larger fiber bundles or unwanted citrus waste through slotted screens or hole screens common to the paper industry.

Continuing with FIG. 2, the fruit by-product treatment process 108 may be used to extract and process fruit fiber. The extraction may be performed using a variety of different techniques and processes, as further described hereinbelow.

D. Digestion/Extraction Process

The digestion/extraction process of the fruit by-product treatment process 108 may isolate fruit fibers and cell wall fragments useful in contributing as a constituent to a papermaking substrate. Pectin (polygalacturonic acid) acts as the stabilizing "cement" that holds cells together in peel, sacks, and seed ultra-structures of fruit. Specifically, pectin is present in cell walls and between the cells, where the middle lamella is a pectin layer that cements the cell walls of two adjoining cells together. A majority of the interlamellar cellular material in fruit is comprised of pectin. The amount of pectin may vary by fruit type or by season, as cell wall disassembly during ripening is the main process leading to fruit softening. The digestion/extraction process is performed to remove the pectin (viewed here primarily as a by-product product) in order to isolate the desired material, i.e., the fruit fibers.

Any method suitable for digesting or extracting fruit fiber is suitable for use in accordance with the principles of the present invention. Digestion methods may include, without limitation, chemical treatment, such as an alkaline treatment 210 and/or acid treatment 212, enzymatic treatment 214, refiner/mechanical treatment 216, or a combination thereof.

The alkaline treatment 210 may be used to digest pectin of the fruit by-product. The alkaline treatment may include, without limitation, sodium hydroxide and sodium sulfide, or combinations thereof. For convenience, an alkaline liquid to dry pulp ratio ranging from about 5:1 up to about 25:1 may be used to treat the pulp with alkali. The alkaline digestion may be carried out in a quiescent setting or by using agitation.

The acid treatment 212 may alternatively or additionally be used to digest pectin of the fruit by-product. Acids that may be used to perform the digestion of the pectin may include mineral, including, without limitation, nitric acid, sulfuric acid, hydrochloric acid, phosphoric acid, boric acid, hydrofluoric acid, hydrobromic acid, and perchloric acid. Treatment liquor to pulp ratios in the range of about 5:1 to about 50:1 are suitable for use, although pectin removal may be facilitated by additional dilutions, e.g., 30:1. Target pH of the acid treatment may range from about 1.1 to about 2.3, although consumption of acid may require addition of acid during treatment. Optionally, a chelant (e.g., EDTA and DPTA) may be added during or after treatment to sequester any free metal ions freed from the digestion and treatment. In one embodiment, the pH may be increased post-treatment to enhance the effectiveness of the chelant. Moderate shear may optionally be applied by stirring or using agitation to facilitate extraction of a more-resistant pectin fraction.

In one embodiment, temperatures may be elevated (e.g., 70° C. to 160° C.) to accelerate solubilization of inter-lamellar material. Due to the presence of many organic acids naturally occurring in the citrus pulp and acidic hydrolysis products formed during processing, pH can drop to below neutral in the alkaline treated pulp. Monitoring pH during this stage may be performed so that refortifying the liquor with additional alkali to maintain higher target pH can be achieved. Alkali treatment can be applied for short periods of 15 and up to 120 minutes at target temperature and pH. Total heating time is determined by the temperature ramp rate controlled by the thermal load capacity of the equipment used in heating and by whether direct or indirect heating is employed.

In another embodiment, the fruit by-product may be digested by an alkaline treatment followed by an acid treatment. The combined use of alkaline and acid treatments is useful to reduce pectin levels early in processing steps due to the solubility of both calcium pectate and nascent pectin. The pH, residence time, and temperature of the chemical treatment can vary with regard to what type and variety of fruit is being extracted. In one embodiment, the pH range for the acid treatment is from about 1.1 to about 2.3 and more specifically, from about 1.6 to about 1.8. In one embodiment, the pH range for the alkaline treatment is from about 9.0 to about 12.50. In another embodiment, the residence time for the chemical treatment is from about 15 to about 120 minutes or more specifically, from about 60 to about 90 minutes. In yet another particular embodiment, the temperature ranges from about 70° C. to about 160° C.

In a particular embodiment, the alkaline treatment 210 is applied in either a pressurized or open vessel. About 2.5% sodium oxide ($Na_2O$, applied as sodium hydroxide) is then applied with about 15% to about 20% $Na_2O$ causticity added as sodium sulfide. At 10% washed citrus pulp solids, chemicals are added and heat is applied by direct or indirect steam, depending on the vessel design, to about 90° C. pH is typically above 12.0 at the introduction of the chemicals and monitored throughout the caustic treatment. The pulp pH may drift as nascent acids neutralize the caustic liquor. After the pH drops to below 8.0, the alkaline treatment 210 may be stopped as any substantial alkaline-driven reactions have ended. The pulp may then be washed to remove residual alkali and reaction products in hot water across a vacuum assisted drainage funnel or through a batch or continuous centrifuge, depending on the quantity treated. Solids and yield may then be determined.

In another particular embodiment, the acid treatment 212 may be used to extract the fruit pulp by using a mineral acid, such as nitric or sulfuric acid. The pulp is suspended at about 4% solids in heated water with moderate agitation. The pulp may then be heated to about 60° C. to about 90° C. and acid added until a pH of 2.0 is achieved. pH may then be monitored about every 10 minutes as the acid is neutralized and/or consumed. A supplement of additional acid may performed to maintain the pH at a pH level of 2.0. After about 90 minutes, pH may then be adjusted upward to a range from about 3.8 to about 4.2 with sodium hydroxide and a chelant added at 800 ppm, based on starting citrus pulp solids. The chelant may be, for example, DPTA. The pulp may then be diluted to about 5% solid and pumped to a flow through double-disk mechanical refiner and then to a continuous centrifuge for dewatering. The outlet solids may range, for example, from about 15% to about 32%.

In another embodiment, the enzymatic treatment 214 may be used for digesting pectin from the fruit by-product to extract the fruit pulp. An enzymatic treatment may be used as an alternative to the alkaline treatment 210 and/or acid treatment 212 or be used in combination with those digestion methods. The enzyme may be, for example, a pectinase. Representative, non-limiting pectinases include pectin galacturonase, pectin methylesterase, pectate lyase, and pectozyme. In a specific embodiment, the enzyme is a cocktail of pectin galacturonase pectin methylesterase, and pectatelyase. The pH and temperature conditions may be dictated by the particular enzyme, as is understood by one of skill in the art. In one embodiment, the temperature may range from about 25° C. to about 55° C. and the pH may range from about 3.5 to about 8.5.

In a still further embodiment, the fruit by-product may be digested by chemical treatment in combination with the refiner or mechanical treatment 216. Where chemical treatment may be supplemented by an additional digestion or extraction, the additional mechanical treatment 216 may be used before or after the chemical treatment. For example, a mechanical or enzymatic treatment can be used either pre- or post-chemical treatment.

Extracted fruit pulp 218 from any of the treatments 210, 212, 214, and 216 may flow along two optional pathways, a bleached pathway 220 and/or unbleached pathway 222. If the extracted pulp 218 flows along the bleached pathway 220, multi pre-treatment and bleaching stages 224 may be performed on the extracted pulp 218 to further clean and increase brightness of the extracted pulp 218, as further described with regard to FIG. 3. If the extracted pulp 218 flows along the unbleached pathway 222, then a charge neutralization stage 226 may be used to neutralize charges of the extracted pulp 218. In one embodiment, the bleached pulp may also pass through the charge neutralization stage 226, which is described below.

E. Charge Neutralization

Any suitable agent or process capable of modifying or neutralizing the size and charge effects of the refined or extracted fruit by-product or pulp 218 can be used in accordance with the principles of the present invention. Neutralizing agents include, but are not limited to, cationic neutralizing agents including cationic monomers, cationic polymers, cationic coagulations, cationic flocculants, and nonpolymeric cationic species. Cationic coagulants are effective in neutralizing and drawing together components in the fruit pulp. A class of higher molecular weight cationic flocculants is also effective in tying smaller particles and appendages to larger particles, thus facilitating drainage. Poly-aluminum chloride (PAC) and aluminum sulfate (alum) or other cationic monomers have also each been found to be effective in reducing the charge in the citrus pulp, and thereby, facilitating drainage and dewatering. Adjusting pH to near-neutral after application of these moieties under acidic conditions may prove effective in insolubilizing these materials while satisfying cationic demand, once re-wet. In one embodiment, the neutralizing agent constitutes from about 0.5% to about 6.0% on an as-received pulp dry weight basis.

In a particular embodiment, the cationic agent satisfies about 30%, about 40%, about 50%, about 60%, about 70%, about 80% or about 90% or about 100% of the surface charge of the refined fruit pulp. The amount of the neutralizing agent may vary, as would be understood by one of skill in the art. In one embodiment, the neutralizing agent is about 2% to about 12.0% on a pulp dry weight basis. In one embodiment, the addition of the neutralization agent increases the drainage rate of the refined citrus pulp by greater than about 40%, about 50%, about 60%, about 70%, about 80%, about 90%. about 100%, about 200% or more in comparison to a refined fruit pulp not subject to neutralization.

F. Intermediate and Post-Treatment Steps

As discussed above, the method of the invention may optionally additional steps. In certain embodiments, the method involves one or more additional steps as part of the method itself, i.e., intermediate steps following digestion and/or prior to any final step. In other embodiments, the method involves one or more additional post-treatment steps following any final step. In each instance, the additional step is intended to prepare the material for further processing, including additional method steps or the production of an end product. When the additional step is intermediate, it is normally intended to remove a reaction product (e.g., acid) from the proceeding step. Nonlimiting, suitable intermediate and/or additional steps may include, for example, washing steps, dewatering steps and/or bleaching steps.

G. Isolation of Fruit Fibers

Following digestion according to any of the methods described herein, fruit fibers are released into the digest solution and, therefore, may be isolated for further processing. Isolation occurs by applying force to the solution such that the fibers are forced together to form a solid mass of isolated fibers. Force may be applied by a variety of methods as further described herein and include, but are not limited to a commercial centrifuge or decanter. Also, in this regard, the solid material following pectin digestion, such as by pectinase, may be isolated and used in any suitable method, such as in the preparation of animal feed.

It may be useful or necessary to dewater the isolated fiber produced by the methods outlined herein for further processing, including for the manufacture of paper. Fruit by-product or pulp contains fibers exhibiting a distinct fiber length distribution as compared to fibers from wood pulp and present some unique challenges for dewatering. Without being bound by any theory, it may be that fruit by-product or pulp also exhibits both surface and internal anionic charges that may enlarge the hydrodynamic surface of the fibers, thus impeding drainage. If the method is to include use of the fibers obtained from the fruit by-product or pulp to be integrated into a paper mill site, then subsequent treatment may be used so as reduce or eliminate drainage impedance during the papermaking process. If, however, the fiber obtained from the fruit by-product or pulp is to be manufactured and then stored as a wet or dry lap, then it may be also necessary to treat the fiber with dewatering agents converting it to a compact form for shipment.

Following isolation of the fibers, in one embodiment, the process 200 optionally includes one or more intermediate bleaching treatments, as provided by the multiple pre-treatment and bleaching stages 224. If the ultimate destination of the fruit pulp is for inclusion in an unbleached paper substrate, it may not be necessary to include a bleaching step. If, however, the fruit pulp is destined for inclusion into bleached products and specified pulp brightness is a feature of the pulp, then brightening process steps may be used to successfully achieve these objectives.

Brightness is generally defined as the percentage reflectance of blue light only at a wavelength of 457 nm. Brightness is typically measured/expressed as GE brightness. GE brightness is measured with directional light incident at 45° with respect to the normal to the sample. The photodetector is mounted on the normal and receives light reflected along the normal-conditions sometimes expressed by the shorthand notation (45° illumination, 0° observation). GE brightness is measured relative to a Magnesium oxide serves as the standard at a GE brightness of 100, where all pulp and paper has GE brightness less than 100.

Both oxidative and reductive bleaching chemistries may be employed in the high brightness development of citrus pulp. Oxidative approaches have proved most effective in both laboratory and pilot plant processes. The bleaching may involve a single or multiple steps. The bleaching agent may be, for example, chlorine dioxide. In a particular embodiment, the method involves a multi-step bleaching protocol as follows:

Bleaching Stage 1:

Chlorine gas or chlorine dioxide may be used at this stage, assuming compatibility with later chemistries. More specifically, chlorine dioxide is applied at between about 2% and about 8% levels at a range of moderate temperatures (50-65° C.) and reaction times (30 to 120 minutes). An aqueous washing stage may follow this bleaching treatment.

Bleaching Stage 2:

Stage 1 treatment creates reaction products that may or may not be removed with simple washing. Acidic oxidation stages (e.g. chlorine or chlorine dioxide used in Stage 1) may optionally be followed by alkaline extraction stage (Stage 2, pH>9.0) or alkaline peroxide stage are particularly effective in removing oxidized reaction products. An aqueous washing stage may follow this bleaching treatment.

Bleaching Stage 3:

Stage 3 treatment may be an oxidative bleaching stage. Depending on the final brightness required, this stage can create fruit pulps in the 80 GE brightness range. Acidic oxidation stages (e.g. chlorine or chlorine dioxide as used in Stage 1) or alkaline oxidation stages (e.g. sodium hypochlorite) can be employed at this stage. Chemical application rates are dependent on the final brightness target. While it may not be required, an aqueous washing stage may follow this bleaching treatment.

Subsequent Bleaching Stages:

Additional bleaching stages may be used to either further brighten the pulp to a higher target or provide a less aggressive chemical treatment in earlier and subsequent stages. In a particular embodiment, there are two or more bleaching treatments, including a first hydrogen peroxide pre-treatment treatment and one or more additional chlorine dioxide intermediate treatments.

In another embodiment, the one or more intermediate washing steps may be performed during the bleaching step(s). As an intermediate step, washing serves to remove solubilized reaction products. There may be a single or multiple intermediate washing steps, i.e., after a single bleach treatment step or after multiple bleach treatment steps. As with pre-treatment washing, the temperature and number of washings may vary.

In a still further embodiment, an optional dewatering step may be performed to remove water from the fiber obtained from the processed pulp. Suitable technologies for intermediate dewatering include, for example, drainage or vacuum disks, batch and continuous centrifugal separation, and mechanical pressing are non-limiting, representative methods and techniques suitable for use to remove water from the processed pulp.

In a particular embodiment, the intermediate treatment involves one or more bleaching steps followed by one or more washing steps.

In a specific embodiment for processing citrus pulp, a digested citrus by-product or pulp may be washed and then transferred to an indirect heated bleaching tower equipped with an up-flow axial contained screw design to facilitate both blending of chemicals with pulp and achieving uniform heating. The citrus pulp may then be heated to about 60° C. Alkaline peroxide is then added at an about 5% to about 10% application rate achieved a final solids of about 10% (on dry pulp) and at pH of about 10.5. After treatment for 1 hour, the pulp slurry may be diluted to about 5% solids and pumped to a continuous centrifuge for dewatering. Washed pulp is then transferred to the same indirect heated bleaching tower above and the citrus pulp is heated to about 60° C. Chlorine dioxide is added at an about 3% application rate to achieve a final solids of 10% (on dry pulp). After treatment for about 1 hour, the pulp slurry is diluted to about 5% solids and pumped to a continuous centrifuge for dewatering.

The washed pulp is then transferred to the same indirect heated bleaching tower as in the previous stage and the citrus pulp is heated to about 50° C. Sodium hydroxide is then added to achieve a final pH of about 11.5 to about 12.0 with solids of about 10% (on dry pulp). After treatment for about 1 hour, the pulp slurry may be diluted to 5% solids and pumped to a continuous centrifuge for dewatering. The washed pulp is once again transferred to the same indirect heated bleaching tower as in the previous stage. The citrus pulp may then be heated to about 60° C. Chlorine dioxide may then be added at about an about 2% application rate to achieve final solids of about 10% (on dry pulp). After treatment for 1 hour, the pulp slurry may be diluted to about 5% solids and pumped to a continuous centrifuge for dewatering.

Figure 3:
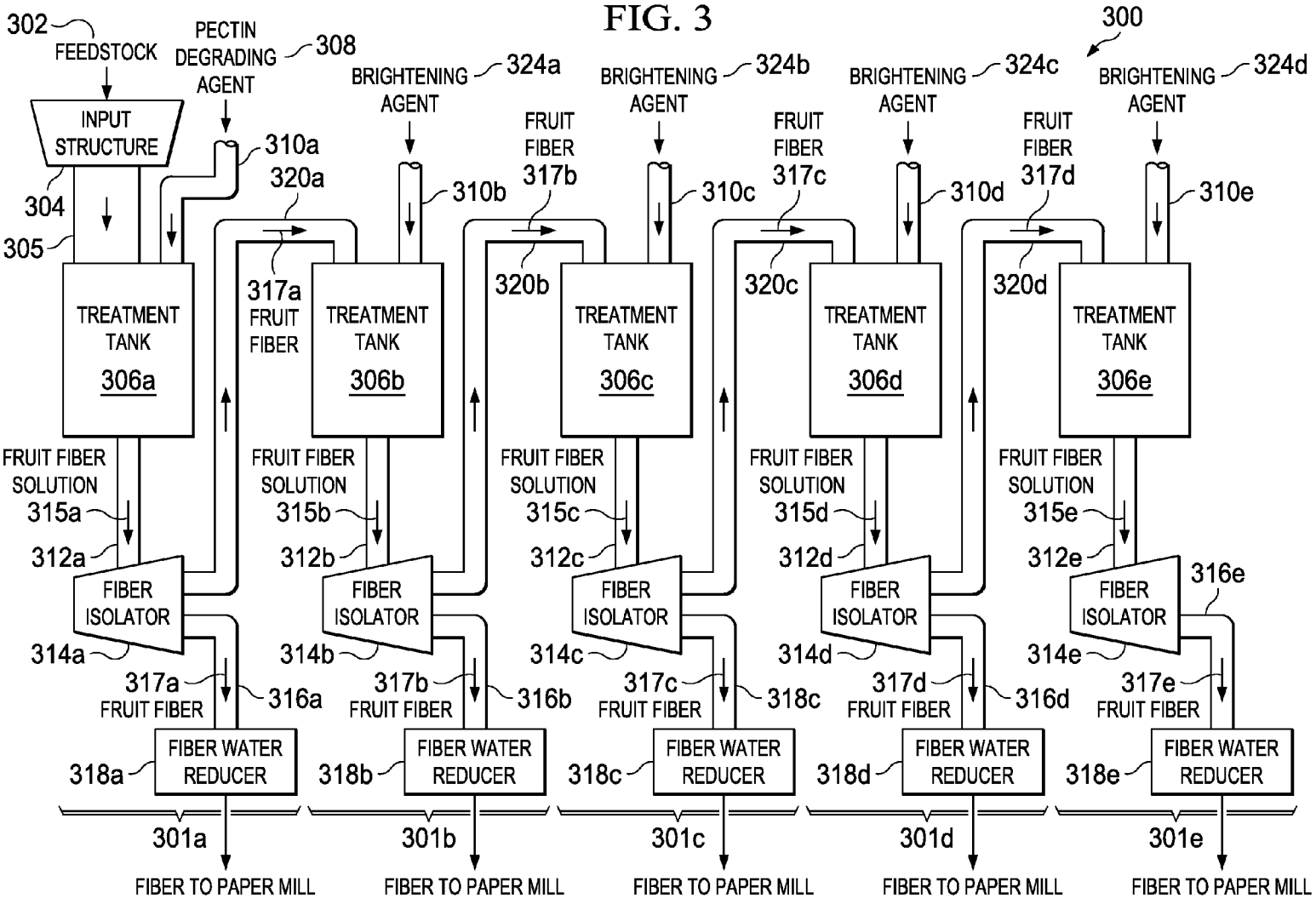
FIG. 3 is a schematic diagram of an illustrative system for use in extracting and processing fruit fiber to produce brightened fiber for use in paper and packaging products.

With regard to FIG. 3, a schematic diagram of an illustrative system 300 for use in extracting and processing fruit fiber from feedstock 302 to produce brightened fiber for use in paper and packaging products is shown. The system 300 includes multiple stages 301*a*-301*e* (collectively 301) for use in extracting and processing the fruit fiber. The first stage 301*a* may include an input structure 304, such as a hopper, that allows for the feedstock 302 to be input into a reactor or treatment tank 306*a* of the system 300 via a conduit 305. The treatment tank 306*a* may be configured to receive the feedstock 302 for processing, such as removing pectin from the feedstock 302 by using a pectin degrading agent 308 via input conduit 310*a*. The degrading agent 308 may be any agent, such as an alkaline, acid, or enzyme, that may be mixed with the feedstock 302 in the treatment tank 306*a* for removing the pectin in the feedstock 302. As a result of mixing the agent 308 with the feedstock 302, the pectin is removed from fruit fiber contained within the feedstock 302, and a solution inclusive of the fruit fiber is formed.

An output conduit 312*a* may be in fluid communication with a fiber isolator 314*a* to transport fruit fiber solution 315 (i.e., solution containing fruit fiber released from the fruit pulp). The fiber isolator 314*a* may be a decanter, centrifuge, agitator, fiber refiner, or any other mechanical or electromechanical device that is capable of isolating or separating the fiber from the solution. As previously described, if the paper or packaging, such as brown paper bags, into which the fiber from the feedstock 302 will be incorporated is not bright, then the fiber isolator 314*a* may output the isolated fiber 317*a* from the fiber isolator 314*a* via conduit 316*a* to a fiber water reducer 318*a*. The fiber water reducer 318*a* may be used to reduce or remove water from the fiber output from the fiber isolator 314*a* to create a fiber with reduced water content for providing to a paper mill to be included with wood pulp in making paper products. The fiber water reducer 318*a* may be a wide variety of machines that use a wide variety of processes, including a machine and process for making wet lap, dry lap, flour, or any other form of fiber material for delivery to a processing destination, such as a paper mill. The various machinery may include presses, dryers, and commercial wet lap machines.

As previously described, certain quality and types of papers are meant to be brighter or have certain qualities that use certain fiber types (e.g., finer or coarser fiber). In addition to using treatment tank 306*a* to removing the pectin from the feedstock 302, the principles of the present invention provide for additional reactor or treatment tanks 306*b*-306*e*. Each of these treatment tanks 306 may be used to increase brightness of the fiber that is processed by a previous treatment stage by use of a brightening agent.

As shown, output conduits 312*a*-312*e* may flow the treated fruit fiber solutions 315*a*-315*e* from the treatment tanks 306*a*-306*e* (collectively 306) to respective fiber isolators 314*a*-314*e* (collectively 314). The fiber isolators 314, as previously described, may be configured to isolate the fiber from solution or non-fibrous material. Conduits 320*a*-320*d* may transport fruit fiber 317*a*-317*d* isolated or otherwise separated from the solution by the respective fiber isolators 314*a*-314*d*. Conduits 310*b*-310*e* are used to input brightening agent 324*a*-324*d* (collectively 324) into respective treatment tanks 306*b*-306*e*. In one embodiment, the brightening agents 324 are identical. Alternatively, the brightening agents 324 may be different (e.g., same agent with different ph levels or different agents). Also coupled to each of the fiber isolators 314*b*-314*e* are fiber water reducers 318*b*-318*e*, which output fruit fibers (not shown) to be delivered to paper mills for inclusion with wood fiber for manufacturing paper. The output fruit fibers from the different fiber water reducers 318*a*-318*e* may be fruit fibers that (i) have been isolated from solution with reduced water content, and (ii) have successively increasing levels of brightness. That is, the output fiber from fiber water reducer 318*a* is the least bright and the output of fiber water reducer 318*e* is the brightest.

Figure 4:
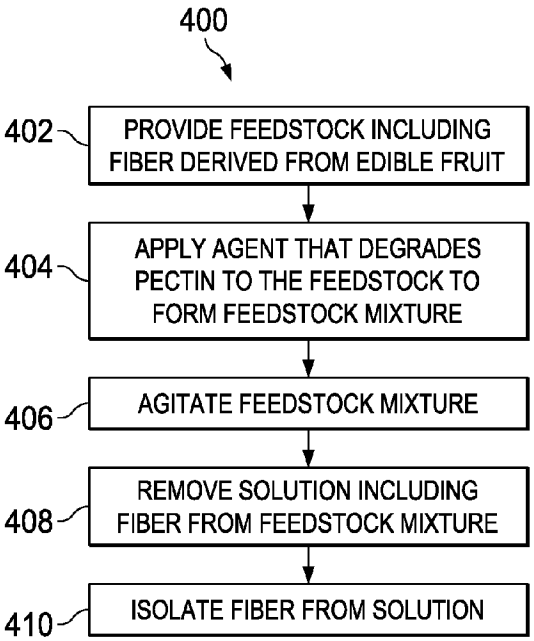
FIG. 4 is a flow diagram of an illustrative process for extracting fruit fiber from fruit by-product.

With regard to FIG. 4, a flow diagram of an illustrative process 400 for extracting fruit fiber from fruit by-product is shown. The process 400 may start at step 402, where a feedstock including fiber derived from edible fruit of a plant may be provided. The edible fruit may be a citrus or non-citrus fruit, as provided hereinabove. At step 404, an agent that degrades pectin may be applied to the feedstock to form a feedstock mixture. In applying the agent, the agent may be applied to the feedstock in a treatment or reaction tank, as understood in the art. The feedstock mixture may be agitated to cause the agent to be more effective in degrading the pectin at step 406. At step 408, solution including the fiber from the feedstock mixture may be removed. In removing the solution, the solution may be removed from the treatment tank by using any process that leaves solid by-product in the tank while removing the solution with the fiber desired to be isolated for use in manufacturing paper. At step 410, the fiber may be isolated from the solution. In isolating the fiber, a decanter, centrifuge, or any other mechanical or mechanical electrical device may be utilized.

Figure 5:
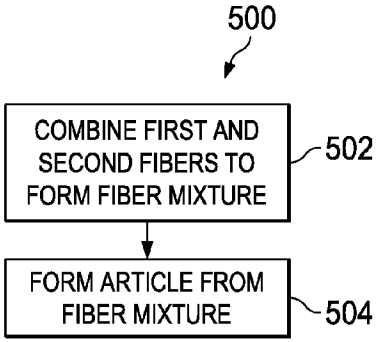
FIG. 5 is a flow diagram of an illustrative process for combining fruit fiber with wood fiber to form an article from the fiber mixture.

With regard to FIG. 5, a flow diagram of an illustrative process 500 for combining fruit fiber with wood fiber to form an article from the fiber mixture is shown. The process 500 may start at step 502, where first and second fibers may be combined to form a fiber mixture. The first fiber is a wood fiber and a second fiber may be a fruit fiber. In combining the two fibers, the fibers may be combined in any manner that provides for manufacturing of paper with the two types of fibers (i.e., wood fiber and fruit fiber). In one embodiment, in combining the first and second fibers, fruit fibers that are substantially similar in shade or brightness to wood fiber may be selected and combined with the wood fiber. Such similarly shaded fruit fiber may be increased in brightness using the system and processes shown in FIG. 3, for example. At step 504, an article may be formed from the fiber mixture. The article may be any paper article, as understood in the art.

II. Method of Manufacturing an Article Comprising Fruit Fiber

The principles of the present invention further relate to a method for processing fruit by-product to provide fruit fiber for use in the preparation of an article comprising the fruit fiber. In an embodiment, the article includes fiber from multiple fiber sources, such as from wood and from fruit, as previously described herein. In an embodiment, the article may be paper and/or packaging materials. The method may include production of storage or transport forms of fruit fiber, such as dried, bagged, bailed, compressed fiber, wet lap, or dry lap, as well as the production of paper therefrom.

Specifically, the method involves processing fruit by-product to provide a fruit fiber storage or transport form, including (i) providing a fruit by-product; (ii) digesting the fruit by-product; (iii) isolating the fiber from the digest solution; and (iv) dewatering the isolated fiber. The fruit fiber storage form may be a dried, bagged, bailed, compressed fiber, wet lap, or dry lap. The fiber in forms has generally undergone some compaction, drying, or consolidation, but has not been dried. These forms are feasible for short distance transportation and if the fiber is to be used immediately at user end (e.g., paper mill). Dry lap would normally be expected to have far less moisture, i.e., about 20% or less.

The principles of the present invention are also directed to a method for making paper, such as a packaging paper, including (i) providing a fruit by-product; (ii) digesting the fruit by-product; (iii) isolating the fiber from the digest solution; (iv) dewatering the isolated fiber; and (v) blending the isolated fiber with wood fiber to create a blended fiber; and (vii) producing paper from the blended fiber. In an embodiment, the fruit fiber may be in wet form when combined with wood fiber.

The fruit fibers, e.g. citrus fibers or non-citrus fruit fibers, are blended with wood fiber. The wood fiber component may be either a softwood fiber or a blended hardwood/softwood fiber. Generally, the citrus or non-citrus fiber replaces only a portion of the wood fiber component of the paper. In one embodiment, the wood fiber-reduced paper is reduced by about 1%, about 2%, about 3%, about 4%, about 5%, about 6%, about 7%, about 8%, about 9%, about 10%, about 11%, about 12%, about 13%, about 14%, about 15%, about 20%, about 25%, about 30%, about 35%, about 40%, about 45% or about 50%, about 60% about 70%, about 80%, about 90%, about 95%, about 99% in comparison to standard paper or packaging paper.

In a particular embodiment, the dewatered fruit fiber is used to make paper. The fiber is diluted to about 3% solids in an agitated tank and then sampled for streaming potential charge. Aluminum sulfate (alum or conventional cationic, coagulant, flocculent, or micro particle chemistries) may be added to the fiber at a rate of about 65 lb./ton to neutralize the charge and improve drainage. In another agitated tank, never-dried, commercially manufactured bleached wood based fiber inclusive of softwood and hardwood pulp at a 70:30 ratio, respectively, may be introduced at about a 3% consistency. The wood fiber blend may then be refined to a desired freeness range, expressed as Canadian Standard Freeness (CSF). In a particular embodiment, the CSF is 450. The wood and citrus fibers may then be blended at about a 90:10 ratio, respectively. Freeness testing may be assessed. The desired CSF may vary. In one embodiment, the CSF ranges from about 300 to about 500 CSF. It is possible to adjust the CSF of the wood fiber component in order to impact the CSF of the blended fiber, for example. The blended fiber may then be pumped to the headbox of the pilot paper machine. The blended fiber may then be drained, pressed, and dried. A starch surface size may be applied and further dried before being wound up on a core. A wide variety of methods are known for the manufacture of paper, as would be understood to one of skill in the art.

III. Wood Fiber-Reduced Paper Including Packaging Paper

Fruit fiber prepared by method above is blended with wood fiber (e.g., softwood or hardwood or hardwood/softwood blends) to create a blended fiber useful in a variety of articles, such as paper, including but not limited to, packaging paper. The desired properties of the paper material or end product dictate the percentage of the wood fiber that is replaced by a citrus or non-citrus fruit fiber substitute. Relevant properties would be understood to those of skill in the art, but generally include tensile properties such as porosity, tensile index, TEA, tensile stiffness, as well as physical properties, such as breaking length, tear index and resistance to bending.

Figure 7:
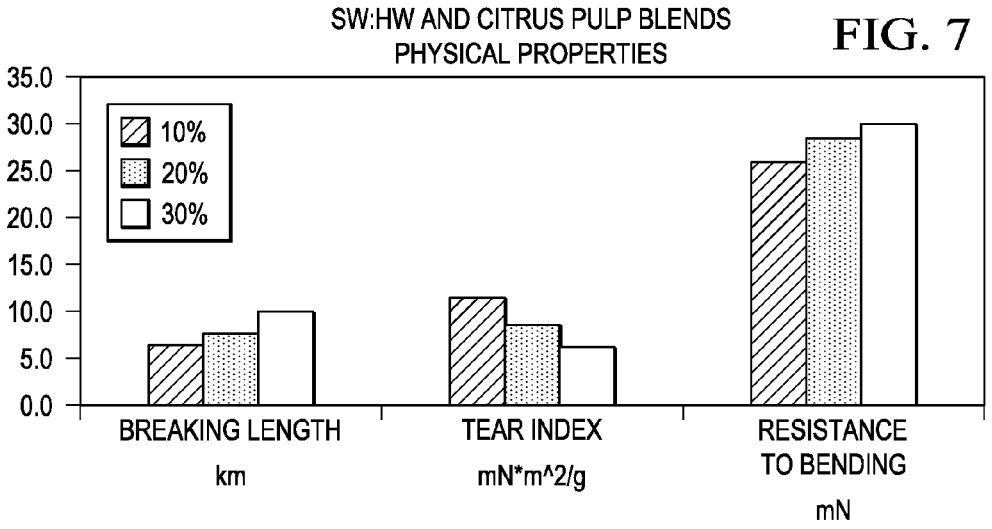
FIG. 7 is a graph of illustrative data showing physical properties (e.g., breaking length, tear index, and resistance to bending) of paper (handsheets) made using various citrus pulp blends.
Figure 8:
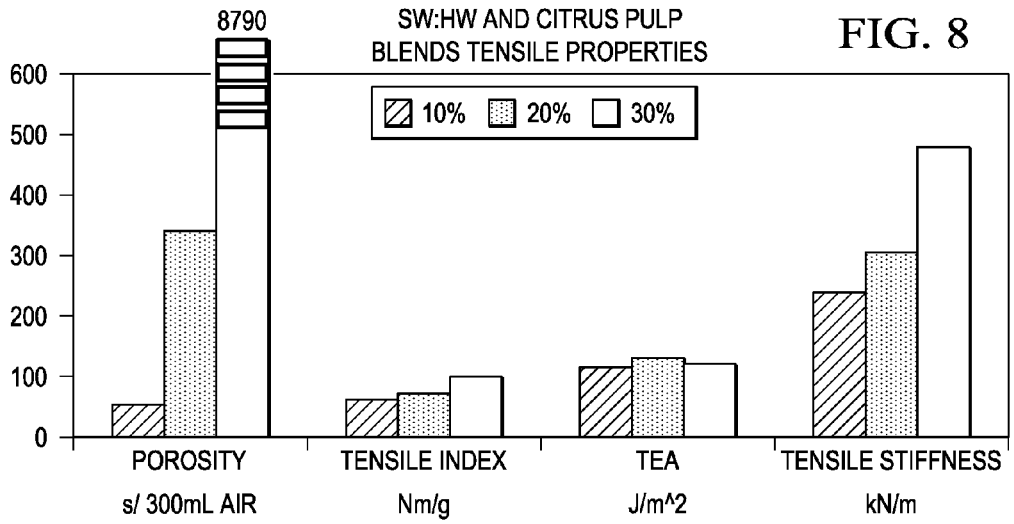
FIG. 8 is a graph of illustrative data showing additional physical properties (e.g., porosity, tensile index, TEA, and tensile index) of paper (handsheets) made using various citrus pulp blends.

In one embodiment, the blended fiber is about 1%, about 2%, about 3%, about 4%, about 5%, about 6%, about 7%, about 8%, about 9%, about 10%, about 11%, about 12%, about 13%, about 14%, about 15% or about 20%, about 25%, about 30%, about 35%, about 40%, about 45% or about 50% citrus or non-citrus fruit pulp. FIGS. 7 and 8 show blended fibers containing various amounts of fruit fiber, ranging from about 10 to about 30%.

The tensile and physical properties of an exemplary fibers ranging from about 10% to about 30% is shown in FIGS. 7 and 8. Specifically, citrus fiber is shown to provide adequate strength for the resulting paper (handsheet) when introduced at levels up to about 30% to about 50%. In a particular embodiment, the blended pulp contains less than about 30% citrus pulp.

Citrus fiber may be useful in a variety of paper bleached and unbleached applications including, for example, corrugated packaging, labels, cups, plates, and liquid packaging. In one embodiment, the principles of the present invention provide for wood-fiber reduced packaging paper. In a specific embodiment, the principles of the present invention include a paperboard carton including fruit fiber, such as citrus fiber extracted from a citrus by-product stream. The paperboard carton may be a beverage carton, for example.

In another embodiment, non-citrus fruit fiber, treated as above, may be blended with wood fiber (e.g., softwood and hardwood/softwood blends) to create a blended pulp useful in paper, including but not limited to, packaging paper. In one embodiment, the blended pulp is about 1%, about 2%, about 3%, about 4%, about 5%, about 6%, about 7%, about 8%, about 9%, about 10%, about 11%, about 12%, about 13%, about 14%, about 15% or about 20%, about 25%, about 30%, about 35%, about 40%, about 45%, about 50%, about 60%, about 70%, about 80%, about 90%, about 95% or about 99% non-citrus fiber.

EXAMPLES

Example 1

Extraction

Dry citrus pellets were received from a citrus processing plant processing sweet oranges. Upon receipt, the pellets were tested for moisture content and stored in refrigerated storage held at 3° C. to 4 C.° until use. One hundred kilograms of dry pellets (oven-dried basis) were introduced into 2500 kg of room temperature water. The mixture was agitated and heated by direct steam to 80° in a pilot-sized hydropulper. After achieving target temperature, the pH was reduced to 1.8 using sulfuric acid. The pH was tested every 10 minutes and adjusted with further acid if the pH was higher than the pH 1.8 target.

After 90 minutes at pH and temperature, the mixture was pumped to a second vessel and diluted to 2.25% solids with warm water; pH was adjusted to 4.0 using 50% sodium hydroxide and temperature maintained above 60° C. Approximately 800 ppm of DPTA on the original pellet weight was added to the mixture after dilution.

The mixture was pumped through a double-disk mechanical refiner set at 0.020" clearance and dewatered using a decanter. The solids fraction was captured in screen carts for subsequent processing while the centrate was sewered.

Example 2

Bleaching Treatment

The washed pulp from Example 1 was transferred to an indirectly heated, axial screw assisted up-flow tower where it was heated to and maintained at 60° C. With the addition of a 50% hydrogen peroxide solution, the $H_2O_2$ was applied at 6% (active on citrus dry solids) and the mixture diluted to result in 10% solids concentration and pH of 10.5-11.0 upon addition. The mixture was maintained at target temperature by indirect heating. After 60 minutes, the material was diluted to 5% solids, pumped to and treated as above, through the decanter.

Washed pulp was transferred to the same indirect-heated, axial bleaching tower. The pre-treated citrus pulp was heated to 60° C. A chlorine dioxide solution (at 10 g/liter) was added to achieve a 4% application rate having a final solids concentration of 10% (on dry pulp) and pH 3.6. After treatment for 1 hour, the pulp slurry was diluted to 5% solids and pumped to and treated as above, through the decanter.

Washed pulp was transferred to the same indirect-heated, axial bleaching tower as in the previous stage. The pre-treated citrus pulp was heated to 50° C. A 50% sodium hydroxide solution) was added to achieve a pH of 10.5, having a final solids concentration of 10% (on dry pulp). After treatment for 75 minutes, the pulp slurry was diluted to 5% solids and pumped to and treated as above, through the decanter.

Washed pulp was transferred to the same indirect-heated, axial bleaching tower as in the previous stage. The pre-treated citrus pulp was heated to 60° C. A chlorine dioxide solution (at 10 g/liter) was added to achieve a 2% application rate having a final solids concentration of 10% (on dry pulp). After treatment for 1 hour, the pulp slurry was diluted to 5% solids and pumped to and treated as above, through the decanter.

The pulp was stored at the decanter discharge solids in poly lined drums under refrigerated conditions.

Example 3

Charge Neutralization

Figure 9:
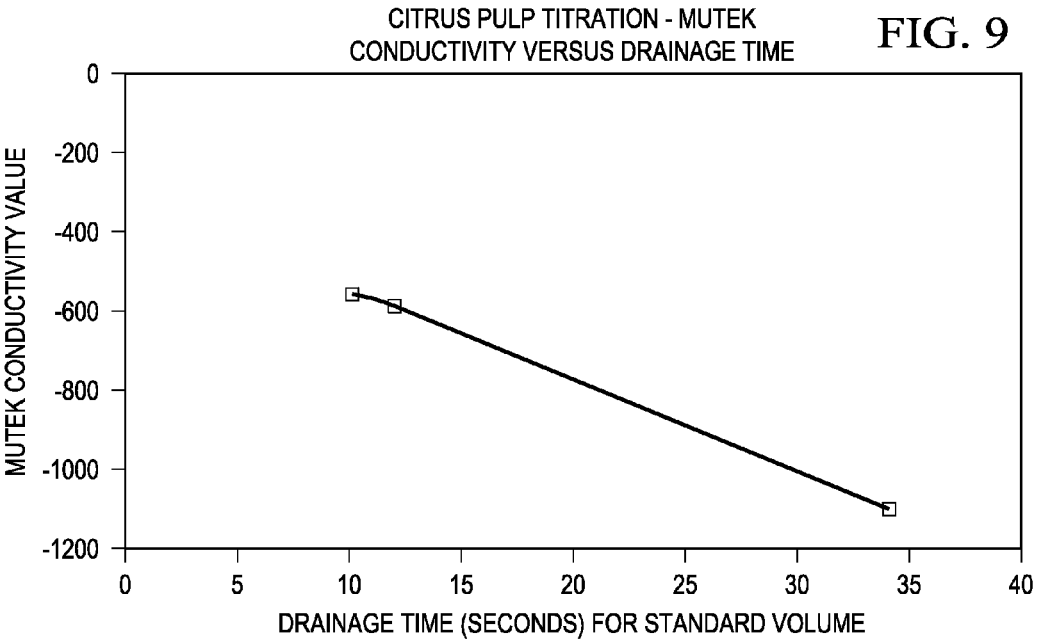
FIG. 9 is a graph of illustrative data showing influence of the addition of a neutralizing agent on drainage time of refined citrus pulp.

The citrus pulp was removed from storage and diluted with room temperature water to 3% solids in an agitated tank. The pulp was sampled for streaming potential charge. Aluminum sulfate (alum) was added to the pulp at a rate of 65 lb./ton to neutralize the charge to about −0 mV. Drainage improvements upon alum neutralization were dramatic, as shown in FIG. 9.

Example 4

Preparation of Blended Pulp

Commercially manufactured bleached wood pulp including softwood and hardwood pulp blended at a 70:30 ratio, respectively, was mixed with room temperature water at 3% consistency. After refining the blend to 470 Canadian Standard Freeness (CSF) units the wood pulp was held until blended with the citrus pulp at a 90:10 ratio, respectively.

Samples of both the wood pulp and citrus pulp prepared in Example 3 were blended at appropriate ratios. The freeness of the blend was tested and determined to decrease to 450 CSF, confirming the impact of neutralizing the citrus pulp with a de minimis decrease in freeness from a 470 units starting point. Several 20 liter samples of both pulps were taken of these pulps and the samples.

Example 5

Production of Paper

The blended pulp from Example 5 was pumped to the headbox of the pilot paper machine without issue. The pulp successfully was drained, pressed and dried on the pilot machine at 310 grams/sq. meter.

Handsheets of the above pulps were made by experienced technicians using TAPPI Standard protocols and test procedures. The tensile and physical properties of the handsheets were tested and the results are shown in FIGS. 7 and 8. Breaking length, tear index and resistance to bending are shown for paper containing varying citrus pulp blends (where the percentage of citrus pulp in the blend ranges from 10-30%), where the citrus pulp component of the blend is prepared from various citrus fruit fractions. Porosity, tensile index, TEA and tensile index are shown for paper containing varying citrus pulp blends (where the percentage of citrus pulp in the blend ranges from about 10% to about 30%), where the citrus pulp component of the blend is prepared from various citrus fruit fractions.

Example 6

Citrus Fiber Characteristics

Figure 10A:
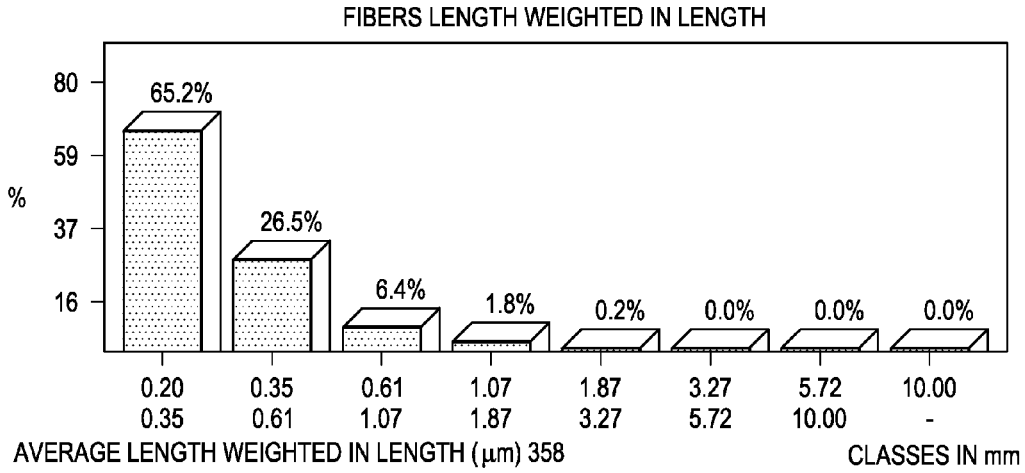
FIG. 10 is a graph demonstrating characteristics of fibers from citrus prepared by the methods herein.
Figure 10A:
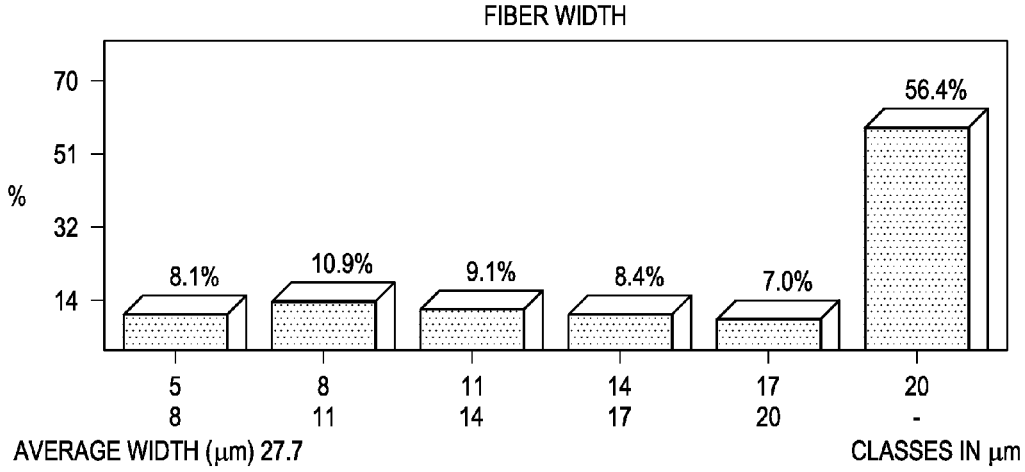
Figure 10A:
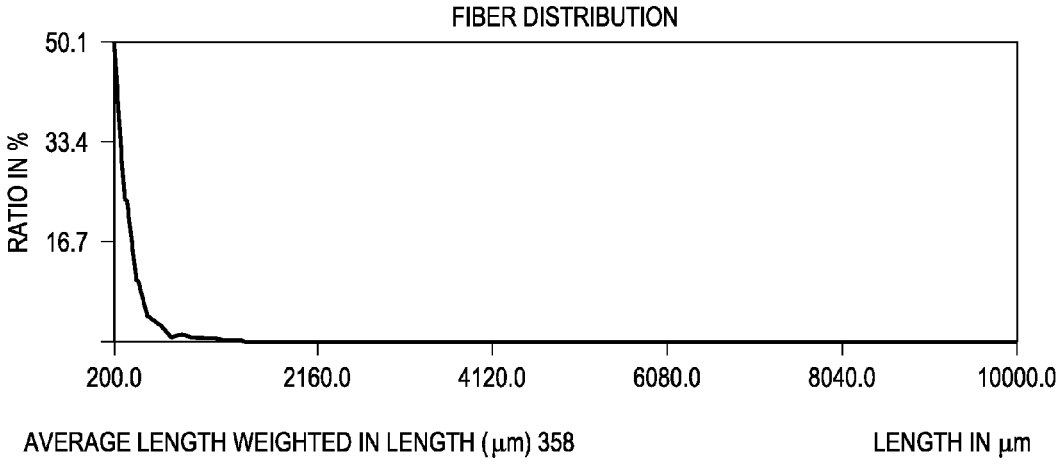
Figure 11A:
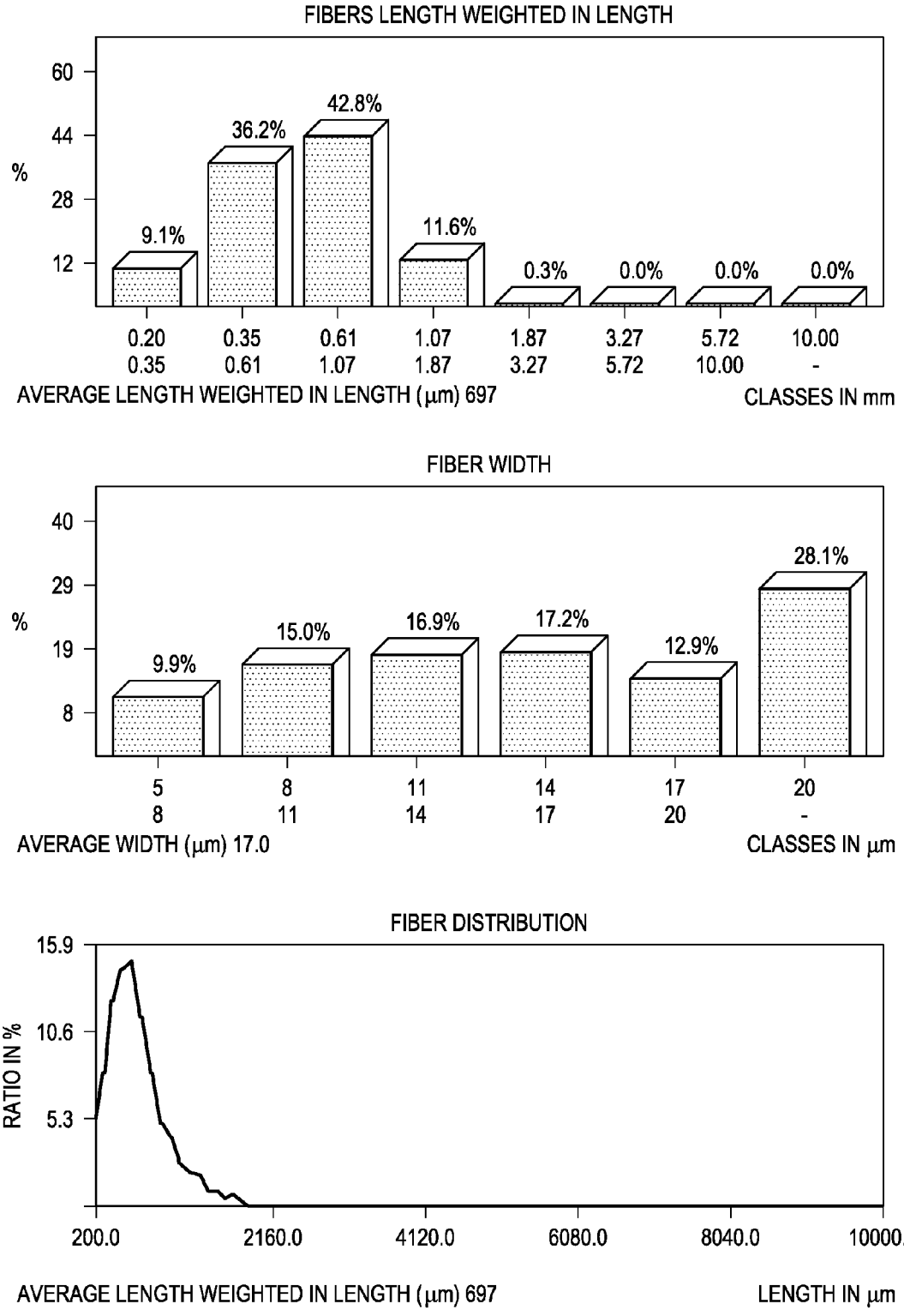
FIG. 11 is a graph demonstrating characteristics of fibers prepared from hardwood.

Citrus fiber prepared as described herein was compared with hardwood fiber. As shown in FIGS. 10 and 11, citrus fiber showed notable differences in length distribution of the fibers. For instance, the majority of citrus fibers were between 0.20-0.35 mm, while the majority of hardwood fibers were longer. Thus, citrus fibers prepared by the methods disclosed herein have distinct distribution of lengths as compared to length distribution of hardwood fibers.

The previous detailed description is of a small number of embodiments for implementing the invention and is not intended to be limiting in scope. One of skill in this art will immediately envisage the methods and variations used to implement this invention in other areas than those described in detail. The following claims set forth a number of the embodiments of the invention disclosed with greater particularity.

What is claimed:

1. A method of manufacturing a fiber for use in manufacturing products, said method comprising:

providing a feedstock including fiber derived from edible fruit of a plant;

applying an agent that degrades pectin to the feedstock to form a feedstock mixture;

agitating the feedstock mixture;

removing solution including the fiber from the feedstock mixture;

isolating the fiber from the solution;

increasing brightness of the isolated fiber using a plurality of successive brightening processes to produce an output fruit fiber at each of the successive brightening processes; and creating a partially dried fiber from at least a portion of the output fruit fiber from one or more of the brightening processes, the physical properties of the fiber include a length of greater than about 0.20 mm.

2. The method of claim 1, wherein the plurality of successive, brightening processes include applying a bleaching agent to the isolated fiber at each of the brightening processes.

3. The method of claim 1, wherein creating the partially dried fiber includes creating the partially dried fiber by using a method selected from bed-drying, using a P-ring dryer, air drying, creating wet lap, or compressing the isolated fiber.

4. The method of claim 1, wherein providing a feedstock includes providing a feedstock in the form of pellets or fresh-never dried fruit by-product.

5. The method of claim 4, wherein providing pellets includes providing pellets in a form selected from the group consisting of dried pellets and partially dried pellets.

6. The method of claim 4, wherein providing fresh-never dried fruit by-product includes providing fresh-never dried fruit by-product from edible fruit selected from the group consisting of albedo, pulp, and endocarp.

7. The method of claim 1, wherein providing a feedstock includes providing a feedstock derived from fruits, vegetables, nuts, or shells of nuts.

8. The method of claim 1, wherein applying an agent includes applying an agent that is an acid or base.

9. The method of claim 8, wherein applying an agent includes applying an acid, and wherein applying the agent includes incubating the agent with the feedstock at a pH from about 1.1 to about 2.3.

10. The method of claim 8, wherein applying an agent includes applying a base, and wherein applying the agent includes incubating the agent with the feedstock at a pH from about 9.0 to about 12.5.

11. The method of claim 8, further comprising neutralizing the charge of the feedstock mixture.

12. The method of claim 1, wherein applying an agent includes applying an agent that is a pectinase.

13. The method according to claim 1, wherein removing the solution including the fiber from the mixture includes removing the solution including between about 2 percent and about 15 percent of fiber.

14. The method according to claim 1, further comprising measuring the brightness of the partially dried fiber as compared to a second fiber.

15. The method of claim 14, further comprising:

repeating increasing, creating, and measuring with the output fruit fiber until the brightness of the partially dried fiber is substantially similar to the second fiber.

16. The method according to claim 1, wherein the physical properties of the fiber include a width of greater than about 5 μm.

17. A method of processing fruit by-product to provide fruit fiber for use in the preparation of an article, said method comprising:

providing a fruit by-product;

digesting the fruit by-product to remove pectin and form a digest solution;

isolating fiber from the digest solution;

bleaching the isolated fiber using a plurality of successive brightening processes to produce an output fruit fiber from one of the brightening processes; and dewatering the output fruit fiber from at least a portion of the output fruit fiber, wherein the physical properties of the fruit fiber include a length of greater than about 0.20 mm.

18. The method according to claim 17, further comprising measuring the brightness of the partially dried fiber as compared to a second fiber.

19. The method of claim 18, further comprising:

repeating bleaching and dewatering with the output fruit fiber until the brightness of the dewatered fiber is substantially similar to the second fiber.

20. The method of claim 17, wherein the isolated fiber is about 1%, about 2%, about 3%, about 4%, about 5%, about 6%, about 7%, about 8%, about 9%, about 10%, about 15%, about 20%, about 25%, about 30%, about 35%, about 40%, about 45%, about 50%, about 60%, about 70%, about 80%, about 90%, about 95%, or about 99% by weight of a blended fiber.

21. The method according to claim 17, wherein the physical properties of the fruit fiber include a width of greater than about 5 μm.

* * * * *